US007032686B2

(12) United States Patent
Barthomeuf et al.

(10) Patent No.: US 7,032,686 B2
(45) Date of Patent: Apr. 25, 2006

(54) DRILLING AND BOLTING HEAD FOR A BOLTING MACHINE

(75) Inventors: Jean-Claude Barthomeuf, Lucenay (FR); Alain Comorge, Genas (FR)

(73) Assignee: Sandvik Tamrock Secoma SAS, Meyzieu (FR)

( * ) Notice: Subject to any disclaimer, the term of this patent is extended or adjusted under 35 U.S.C. 154(b) by 0 days.

(21) Appl. No.: 10/951,682

(22) Filed: Sep. 29, 2004

(65) Prior Publication Data

US 2005/0103509 A1 May 19, 2005

(30) Foreign Application Priority Data

Nov. 18, 2003 (FR) ..... 03 13483

(51) Int. Cl.
*E21B 7/02* (2006.01)

(52) U.S. Cl. ..... 173/189; 173/28; 173/37; 173/42; 405/259.1; 405/288

(58) Field of Classification Search ..... 173/4, 173/11, 28, 37, 39, 42, 186, 31, 32, 189, 184, 173/192; 405/303, 288, 259.6, 259.1
See application file for complete search history.

(56) References Cited

U.S. PATENT DOCUMENTS 3,375,880 A * 4/1968 Pyles et al. ..... 173/37
3,768,574 A * 10/1973 Long ..... 173/189
3,951,215 A * 4/1976 Galis ..... 173/189
4,108,253 A * 8/1978 Woodford, II ..... 173/189
4,290,490 A * 9/1981 Barthe et al. ..... 173/189
4,398,850 A * 8/1983 Talvensaari ..... 405/259.6
4,420,277 A * 12/1983 Hibbard et al. ..... 405/259.5
4,832,536 A * 5/1989 Spross et al. ..... 405/303
6,497,536 B1 * 12/2002 Neilson et al. ..... 405/288
6,602,026 B1 * 8/2003 Neilson ..... 405/259.1
6,698,529 B1 * 3/2004 Coombs et al. ..... 173/4

* cited by examiner

*Primary Examiner*—Scott A. Smith
(74) *Attorney, Agent, or Firm*—Oliff & Berridge, PLC

(57) ABSTRACT

The drilling and bolting head (7) of compact structure, is designed for use in mine galleries of small height. It comprises: a transverse table (8) connected to the carrying vehicle, preferably with a device (9 to 12) for lifting this table (8); a slide (13) displaceable along the table (8); an intermediate support (16) displaceable vertically on the slide (13); a vertical beam (21) mounted pivotally on the intermediate support (16); a vertical slideway (23) guided vertically on the beam (21); a drill (26), with a device (33, 34) for the drilling and setting of bolts, which is guided vertically on the slideway (23); motorized device (14, 18, 30) for controlling the various movements. The intermediate support (16) possesses an upper part (20) which can be used as a prop, in combination with a jack (18) arranged along the vertical pivot axis (19) of the beam (21).

19 Claims, 6 Drawing Sheets

DRILLING AND BOLTING HEAD FOR A BOLTING MACHINE

BACKGROUND OF THE INVENTION

The present invention relates, in general terms to what are known as bolting machines intended for carrying out underground jobs, in particular in mine workings. This invention relates more particularly to a drilling and bolting head, also designated here more simply as a "bolting head", provided for equipping such a bolting machine, the bolting head having a highly compact structure and being designed for use in mine galleries of small height, this head being mounted on a carrying vehicle, itself of small height.

A bolting head is an assembly supported by a carrying vehicle and making it possible to set supporting bolts in a mechanized way in the roof of a mine gallery.

DESCRIPTION OF THE PRIOR ART

In the conventional design, a bolting head is mounted at the end of a supporting arm of adjustable length. The assembly thus formed by the bolting head and by its supporting arm is bulky and does not allow use in mine galleries of small height; in this respect, not only must the overall size of the bolting head and of its supporting arm be taken into account, but also the considerable range resulting from this in terms of the movements for bringing the bolting head into each desired working position and the movements for this bolting head to pass from one position to another.

SUMMARY OF THE INVENTION

The present invention aims to avoid these disadvantages by providing a drilling and bolting head of highly compact structure, designed for use and transport in mine galleries of small height and under other conditions where the available space is limited, by virtue of a reduction in the overall size both in height and laterally and in headway, while at the same time preserving easy handling qualities and great ease of use as well as good stabilization in the working position.

For this purpose, the subject of the invention is essentially a drilling and bolting head of the abovementioned type which comprises in combination:

an intermediate support mounted slideably in the vertical direction, at least in the position of use, on an element capable of being connected to a carrying vehicle, and, at least in the position of use, defining a vertical axis of rotation;

a vertical beam which is mounted pivotally, along the vertical axis defined by the intermediate support, and which is provided with means of vertical guidance;

a vertically arranged slideway which is mounted slideably on the means of vertical guidance equipping the vertical beam and which is itself provided with means of vertical guidance;

a drill, with means for the drilling and for the fitting of bolts, said drill being mounted slideably on the means of vertical guidance equipping the slideway;

a horizontal bearing plate which can be used as a mine prop and which is provided in the upper part of the intermediate support;

for controlling the vertical displacement of the intermediate support, a jack arranged vertically along the vertical axis of rotation defined by said support;

motorized means for controlling the displacement of the slideway in relation to the vertical beam and the displacement of the drill in relation to the slideway.

Thus, the bolting head which is the subject of the invention possesses a part orientable about a vertical axis, along which is arranged a jack which performs the twofold task of "the advance to the block" for the slideway and of acting as a prop for supporting the roof of the gallery, this construction principle allowing especially compact implementation integrating all the necessary functions.

In an advantageous embodiment, in terms of compactness, the intermediate support is mounted and guided in translational movement on a transversely arranged table provided with means for connecting the latter to one end of the carrying vehicle, motorized means being provided for controlling the displacement of the slide along the table. This embodiment dispenses with the customary supporting arm.

The means provided for connecting the table to one end of the carrying vehicle are preferably arranged so as to make it possible for this table to be raised and lowered. These connection means may comprise, on the one hand, fork joints for the articulation of the table about horizontal axes on bases fastened to the end of the carrying vehicle and, on the other hand, at least one jack mounted between the carrying vehicle and said table.

The means of controlling the displacement of the slide along the table may comprise a motor carried by said table and an endless chain transmission connecting the motor to the slide.

It is still conceivable, however, that the intermediate support is mounted slideably in the vertical direction on a front part of a telescopic supporting arm, the rear element of which is connected pivotally about a vertical axis to one end of the carrying vehicle, motorized means being provided for controlling the pivoting of the supporting arm and the telescoping of this supporting arm. This other embodiment preserves substantially a compact structure.

In addition, the intermediate support may be mounted pivotally about a longitudinal axis with respect to the slide or with respect to the front part of the supporting arm, depending on the embodiment, in order to "lay down" the bolting head when the latter is not in use, thus reducing its height and facilitating the displacements of the bolting machine equipped with this bolting head.

In a particular embodiment of the bolting head which is the subject of the invention, the slideway is provided with rear vertical guides mounted slideably in guide shoes equipping the vertical beam and is also provided with front vertical guides, on which the drill is mounted slideably. The motorized means for controlling the displacement of the slideway in relation to the vertical beam and the displacement of the drill in relation to the slideway advantageously comprise a single motor which, in particular, is carried by the vertical beam and which, by means of at least one chain passing over guide wheels, controls the abovementioned displacements. A telescopic device is thus obtained, in which the overall stroke of the drill results from the addition of the displacement of the slideway in relation to the beam and of the displacement of the drill on the slideway.

In a preferred embodiment of the invention, the bolting head also comprises means for the prepositioning, in a desired angular position or range, of the orientable assembly consisting of the vertical beam, of the slideway and of the drill in relation to the intermediate support. These means may comprise, on the upper part of the intermediate support, a prepositioning quadrant provided with a series of notches, and, articulated on the top of the vertical beam, a locking lever capable of being introduced into one of the notches of the prepositioning quadrant.

According to another possibility, said prepositioning means comprise, on the intermediate support, a horizontal upper plate in which are formed, on one and the same circle centered on the vertical axis of rotation defined by said support, at least two successive slots in the form of an arc of a circle, of angular extent corresponding to the range of rotation of the slideway between the drilling position and the bolt introduction position, while the above-mentioned beam has mounted on it a vertical jack, of which the moveable element directed upward, is capable of being engaged selectively into one of the slots in the form of an arc of a circle. The ends of the slots in the form of an arc of a circle thus form the stops which, for each selected working zone, define the two particular positions of the slideway.

The drill, which is a compact drill executing, at each operating cycle, the drilling of a hole followed by the setting of a bolt, is advantageously mounted on a support, which also carries laterally a vertical receptacle, for the positioning and introduction of a bolt, said receptacle and the drilling line of the drill being located on one and the same circle centered on the abovementioned vertical axis.

The invention thus provides, overall, a bolting head which is especially compact for both bolting in the vertical direction and in the forward/rearward direction, particularly when the customary supporting arm is replaced by a table affording a transverse and also raising movement, while the vertical axis of advance to the block coincides with the pivot axis of the slideway. The telescopical functioning slideway, being adapted to the available height, is inscribed within the overall size of the machine, while remaining vertical, when said slideway is retracted, thus making it possible to displace the machine between two successive drilling and bolt setting positions, without the need for the slideway to be laid down. Thus, the design of the bolting head according to the invention eliminates a normally necessary rotational movement, thus allowing a time saving and therefore affording a gain in productivity.

Moreover, the means for prepositioning the slideway and the receptacle provided for the positioning and introduction of a bolt make the bolting head of the invention easy to handle and easy to use. With this in view, all the motorized translational and rotational movements of the bolting head are preferably radio-controlled movements.

BRIEF DESCRIPTION OF THE DRAWINGS

The invention will be understood more clearly from the following description, with reference to the accompanying diagrammatic drawing which illustrates by way of example some embodiments of this drilling and bolting head and in which.

Referring first of all to FIGS. 1 to 5, a first embodiment of the bolting head which is the subject of the present invention will be described in full.

DESCRIPTION OF THE PREFERRED EMBODIMENTS

Figure 1:
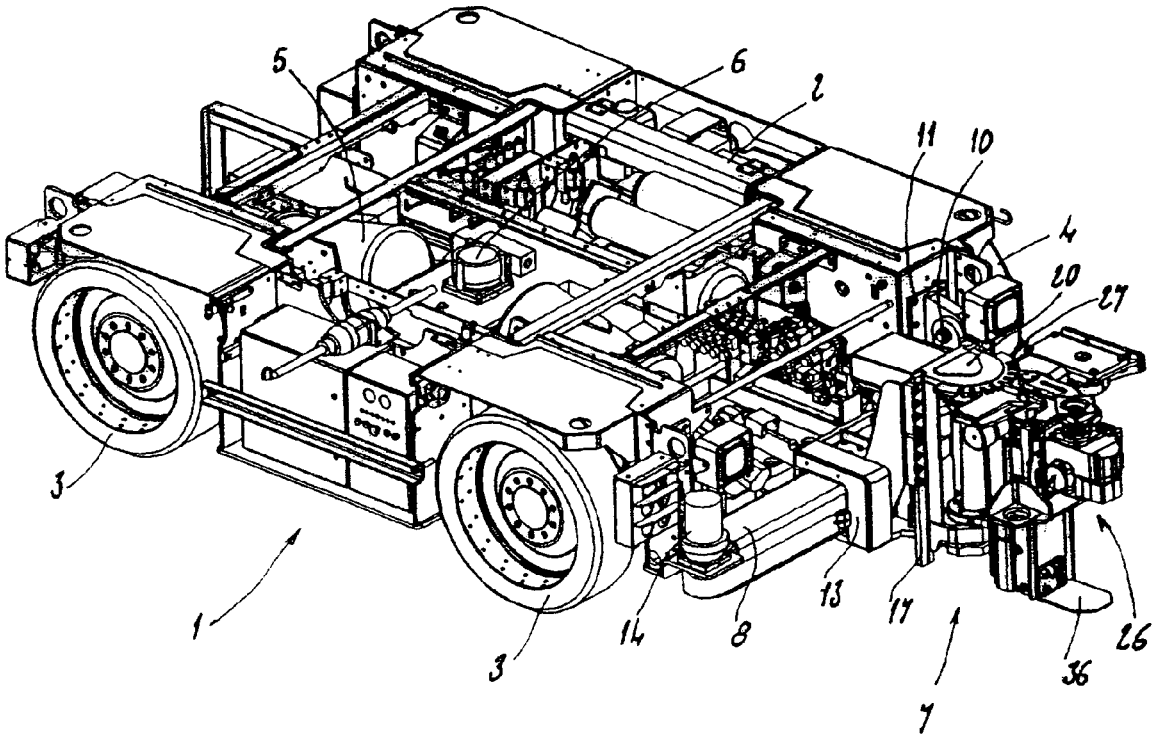
FIG. 1 is an overall perspective view of a bolting machine equipped with a bolting head according to the present invention, mounted on a transverse table.
Figure 2:
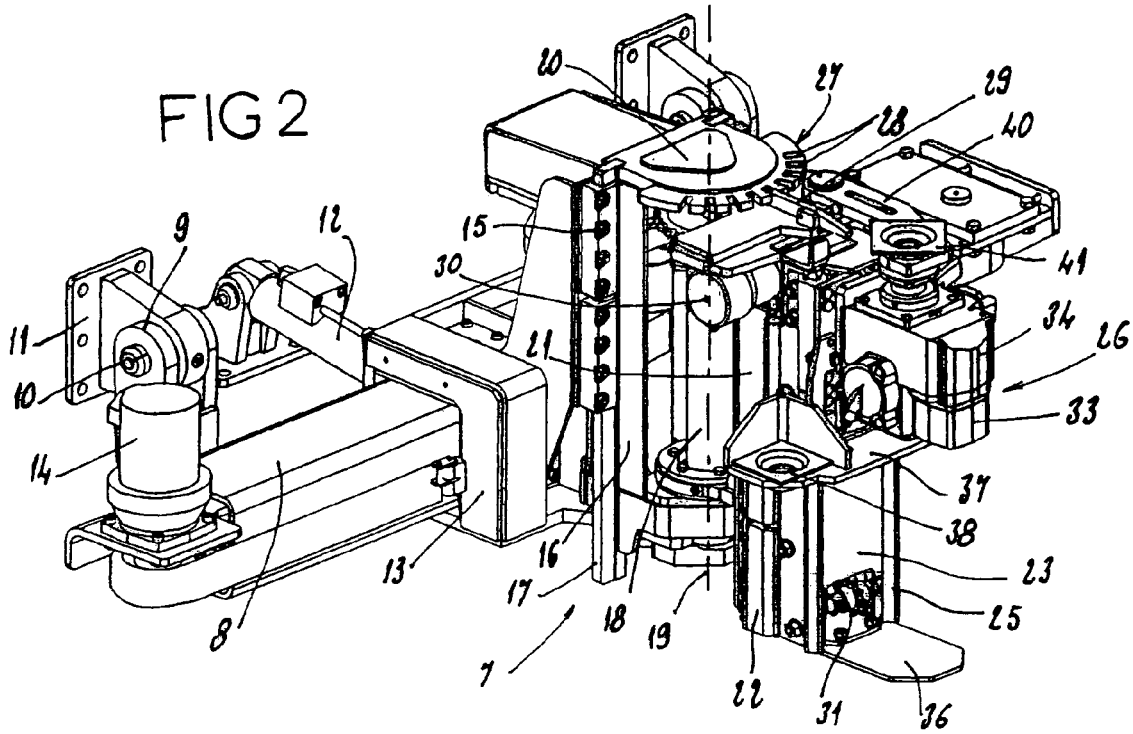
FIG. 2 is a perspective view of the bolting head of FIG. 1, alone.
Figure 3:
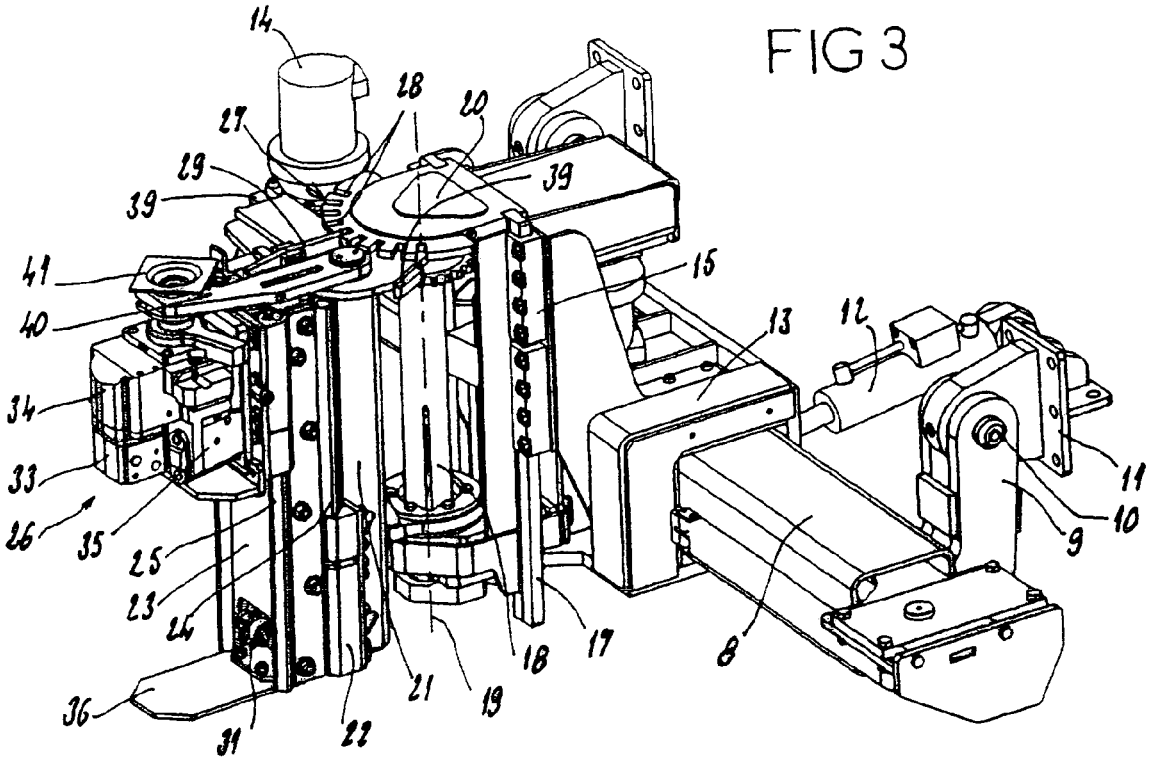
FIG. 3 is another perspective view of this bolting head.

FIG. 1 shows, as a whole, a bolting machine for mine workings, with a carrying vehicle 1 which, in the example illustrated, comprises a rigid monobloc chassis 2 and four motor wheels 3, 4, to be precise two wheels 3 located on the right side of the chassis 2 and two other wheels 4 located on the left side of the chassis 2. This chassis 2, of parallelepipedal general shape, possesses a plane horizontal upper face located at a relatively small height (in particular, smaller than one meter) above the ground on which the carrying vehicle 1 is displaced by means of its wheels 3, 4. Each motor wheel 3, 4 has an independent parallelogram suspension and is driven by means of a hydraulic motor, fed by a motor-driven pump unit 5, from a hydraulic reservoir 6.

The chassis 2 of the carrying vehicle 1 is equipped, at the front, with a bolting head designated as a whole by the reference 7 and forming more particularly the subject of the present invention, the bolting head 7 being illustrated in more detail in FIGS. 2 to 5.

The bolting head 7 is mounted on a table 8, arranged in a transverse horizontal direction, at the front of a chassis 2 of the carrying vehicle. The table 8 is provided, at the rear, with two fork joints 9 directed upward and each articulated about a transversely oriented horizontal axis 10 on a base 11 fastened at the front on the chassis 2. A central jack 12 mounted between the chassis 2 and the table 8 ensures the raising or lowering of this table 8.

Mounted and guided in translational movement on the table 8 is a slide 13 displaceable transversely by means of a motor 14, carried by one end of the table 8, and by means of an endless chain transmission. The slide 13 carries, on its front face, vertically arranged guide shoes 15 which form two vertical sliding guides.

A moveable support 16 provided with two vertical lateral slideways 17 is mounted slideably in the vertical direction by means of its two slideways 17 in the guide shoes 15 carried by the slide 13. A jack 18 arranged along a vertical axis 19 controls the vertical sliding movement of the support 16 in the guide shoes 15. This support 16 is provided in its upper part with a horizontal bearing plate 20 which can be used as a prop.

The lower and upper parts of the moveable support 16 serve as bearings for the rotary mounting, along the vertical axis 19 of the jack 18, of a vertical beam 21 provided at the front with vertically arranged guide shoes 22.

A drilling and bolting slideway 23 arranged vertically is provided with a pair of rear vertical guides 24 mounted slideably in the vertical direction in the guide shoes 22 of the beam 21. The slideway 23 is also provided with a pair of front vertical guides 25, on which a drill 26 is mounted slideably in the vertical direction.

The assembly consisting of the beam 21, of the slideway 23 and of the drill 26 is thus mounted orientably about the vertical axis 19. This assembly can be prepositioned in the desired angular position by means of a prepositioning quadrant 27 carried by the upper part of the support 16 and provided with a series of notches 28, into one of which is introduced a locking lever 29 articulated on the top of the beam 21.

A hydraulic motor 30 carried by the upper part of the beam 21 controls, by means of a chain passing over various guide wheels, such as that which can be seen at 31, on the one hand, the vertical translational movement of the slideway 23 in relation to the beam 21 and, on the other hand, the vertical translational movement of the drill 26 in relation to the slideway 23; these two movements are added together to provide the total stroke of the drill 26 according to a "telescoping" principle.

The drill 26, of compact structure and, in particular, of small vertical dimension, comprises guide shoes 32 cooperating with the front vertical guides 25 of the slideway 23, a rotary motor 33 associated with a reduction unit 34, and a striking device 35. A plate 36 for protecting the rear part of the drill is carried by the lower part of the slideway 23.

This drill 26 is mounted on a support 37 which is provided with guide shoes 32 and which also carries laterally a vertical receptacle 38 used for positioning and introducing a bolt into the drilled hole. The receptacle 38, located on the side of the drill 26, is located on the same circle (centered on the vertical axis 19) as the drilling line of the drill 26. Two stops 39 ensure the appropriate angular positioning of the slideway 23 in the drilling position or in the bolt introduction position.

The upper part of the beam 21 also carries an upper guide 40 of the "steady rest" type for the drilling tool. A mining plate has been illustrated at 41, which takes its place in the usual way between the bolt and the wall of the mine gallery in which the bolt is driven.

Figure 4:
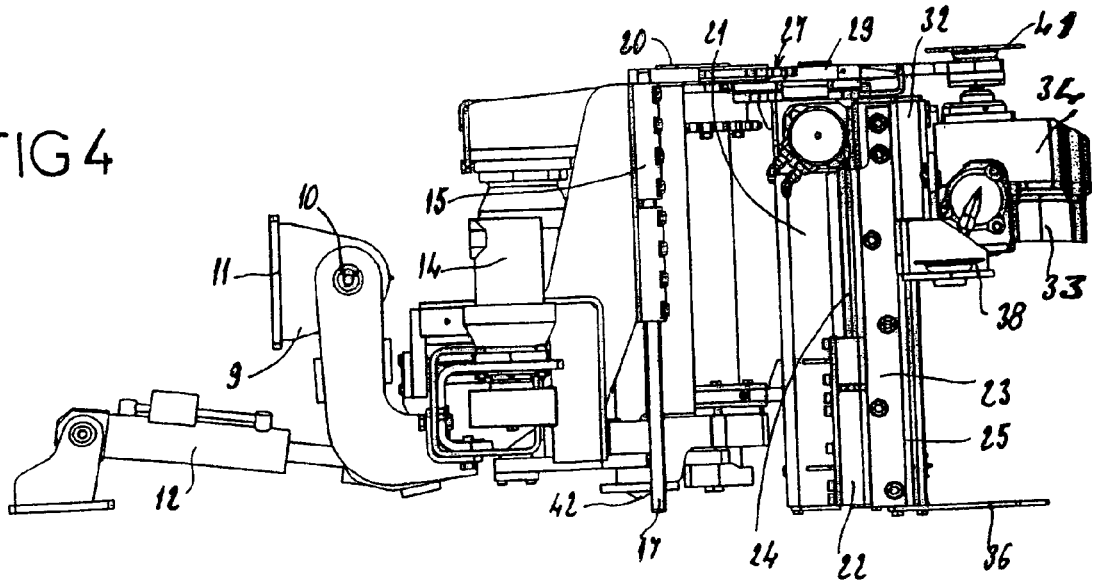
FIG. 4 is a side view of the bolting head of FIGS. 2 and 3.
Figure 5:
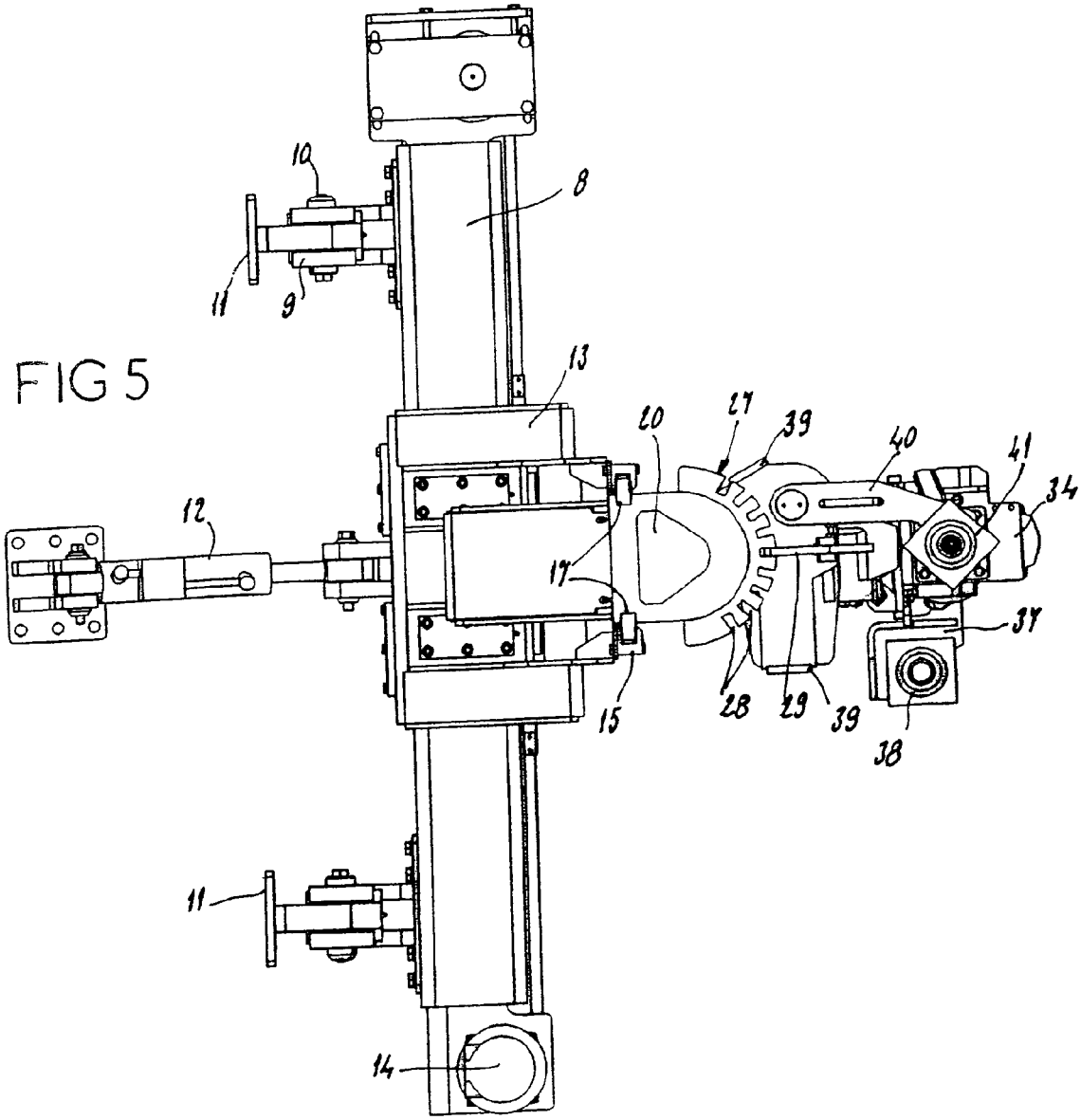
FIG. 5 is a plan view over said bolting head.

Finally, as shown partially at 42 in FIG. 4, another jack fastened vertically to the slide 13 acts as a prop in the downward direction.

A radio-control device, not illustrated, is provided for the remote control of the various motorized translational and rotational movements of the bolting head 7, including rotation about the vertical axis 19 (controlled by an actuator which cannot be seen in the drawing).

To use this bolting head 7, the assembly consisting of the beam 21, of the slideway 23 and of the drill 26 is first prepositioned, for good visibility and to fix the drilling and bolt introduction positions in an exact angular range. The prop is formed by the jack 19 and the bearing plate 20 of the support 16, on the one hand, and by the jack 42, on the other hand, in order to support the roof of the mine gallery, while at the same time bearing firmly on the ground of this mine gallery.

Then, by means of the drill 26, the drilling of a hole in the roof of the gallery may be carried out, the drill 26 being advanced by means of the action of the motor 30 and exerting a rotary percussive action by virtue of the combined operation of its rotary motor 33 and of its striking device 35. Drilling may take place, using first a drilling rod and then a rod extension piece if the length of the bolt to be set so requires.

After the drilling of the hole, the drill 26 is withdrawn (that is to say, lowered), then the vertical receptacle 38 is brought into the axis of the drilled hole for the positioning and introduction of the bolt, and, finally, this bolt is driven into the drilled hole by the control of the translational and rotational movement of the drill 26.

Figure 6:
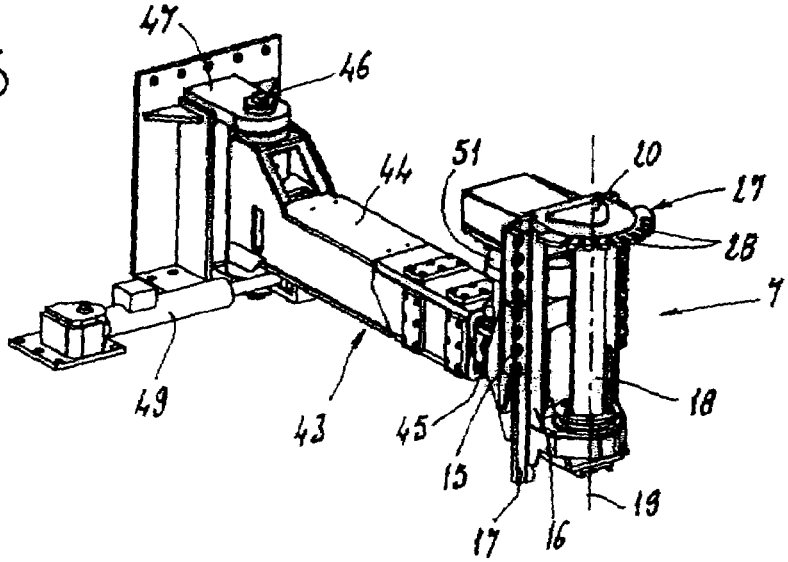
FIG. 6 is a partial perspective view of a bolting head similar to that of the preceding figures, but mounted on a supporting arm.
Figure 7:
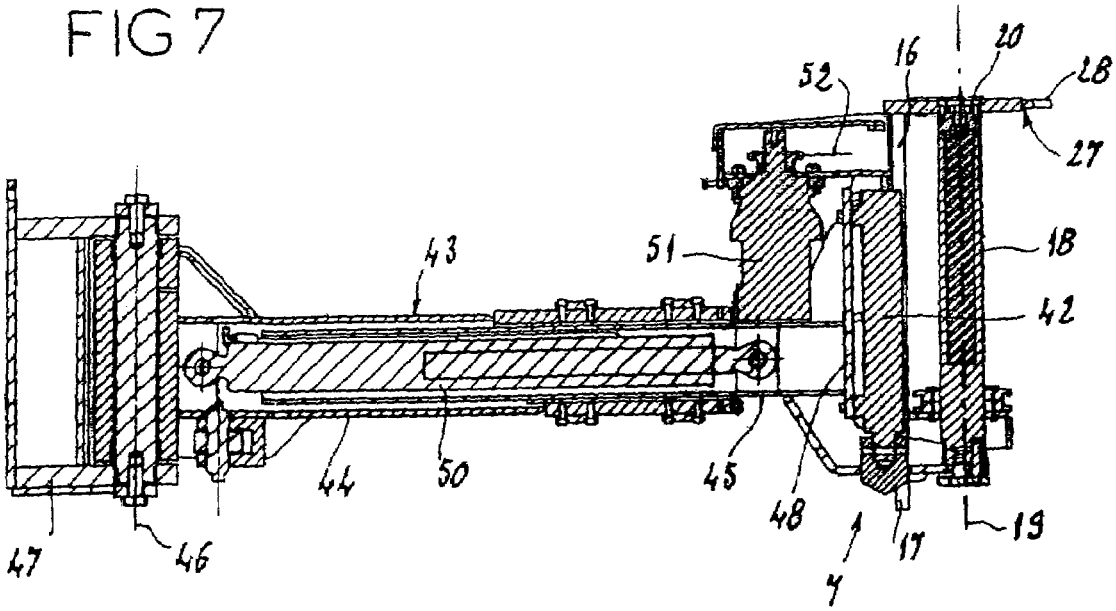
FIG. 7 is a view in longitudinal section of the bolting head and of its supporting arm according to FIG. 6.

FIGS. 6 and 7 illustrate, partially, a second embodiment of the bolting head 7 which is the subject of the present invention.

In this second embodiment, the table 8 and the slide 13 of the preceding embodiment are replaced by a telescopic supporting arm 43 of relatively short length. The supporting arm 43, which extends substantially horizontally, is composed of a rear element 44 and of a front element 45 mounted slideably within the rear element 44. This rear element 44 is mounted pivotally about a vertical axis 46 on a fork joint 47 fastened at the front of the chassis of the carrying vehicle (not illustrated here). At the front end of the front element 45 of the supporting arm 43 is mounted a vertical end plate 48 (equivalent to the slide 13 of the first embodiment) which is provided with vertical guide shoes 15 forming the vertical sliding guides of the moveable support 16 of the bolting head 7 (illustrated partially here).

A lateral jack 49 controls the pivoting of the supporting arm 43 about the vertical axis 46. Another jack 50, mounted within the supporting arm 43, controls the translational displacement of the front element 45 in relation to the rear element 44, hence the telescoping of the supporting arm 43. As already described above, a jack 18 arranged along a vertical axis 19 controls the vertical sliding of the support 16 in the guide shoes 15. FIG. 7 also shows the jack 24 which acts as a prop in the downward direction, and also the motor 51 which, by means of an endless chain 52, controls the rotation of the front part (not illustrated) of the bolting head 7 orientable about the vertical axis 19.

The preceding descriptions consider the bolting head 7 in a vertical position of use. However, in a way not directly illustrated, the bolting head 7 may be made pivotal about a longitudinally oriented horizontal axis with respect to the slide 13 (first embodiment) or with respect to the end plate 48 of the supporting arm 43 (second embodiment), in order to "lay down" the bolting head 7 and, in particular, its slideway 23 when it is not in use, in order to facilitate the displacements of the bolting machine.

Figure 8:
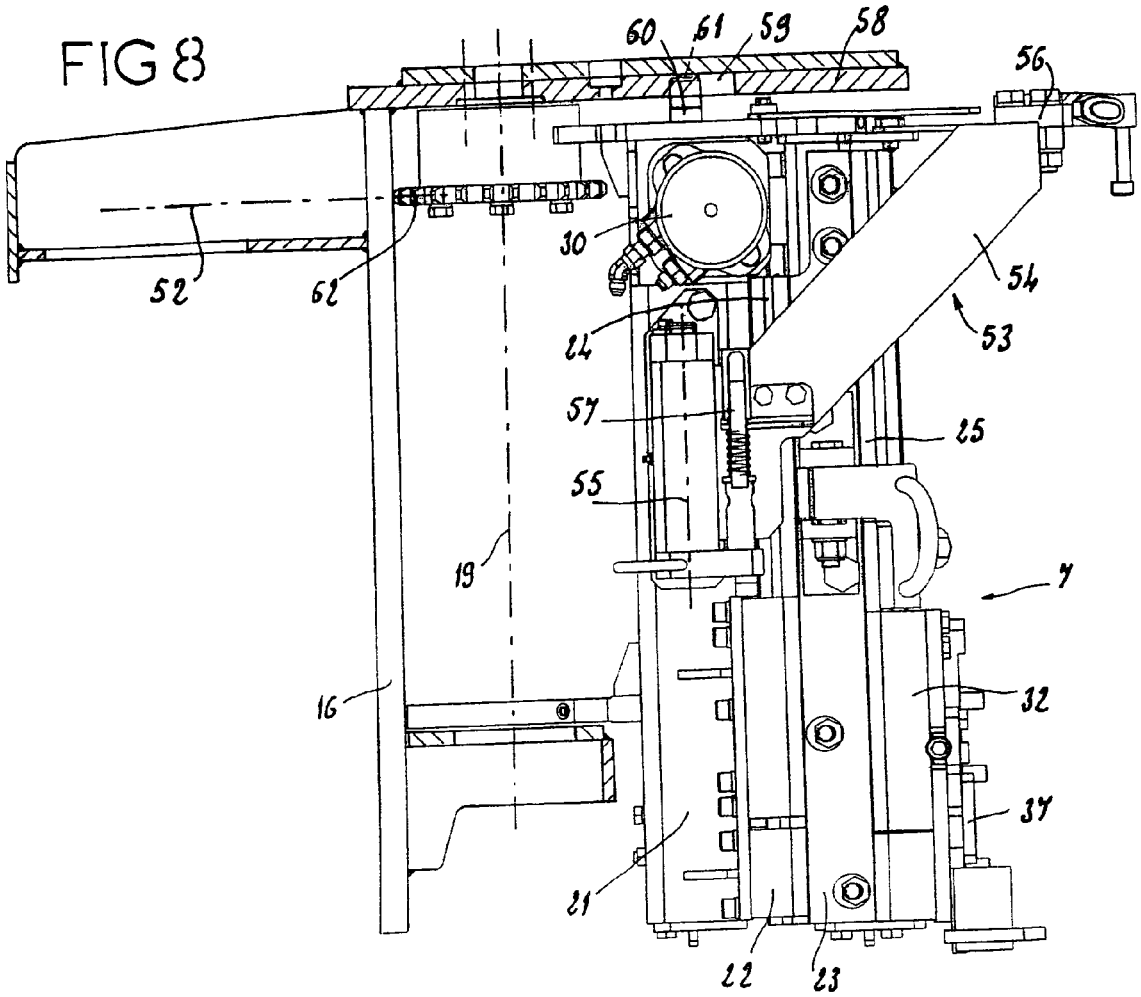
FIG. 8 is a partially sectional side view of another bolting head according to the invention, illustrated here without its drill.
Figure 9:
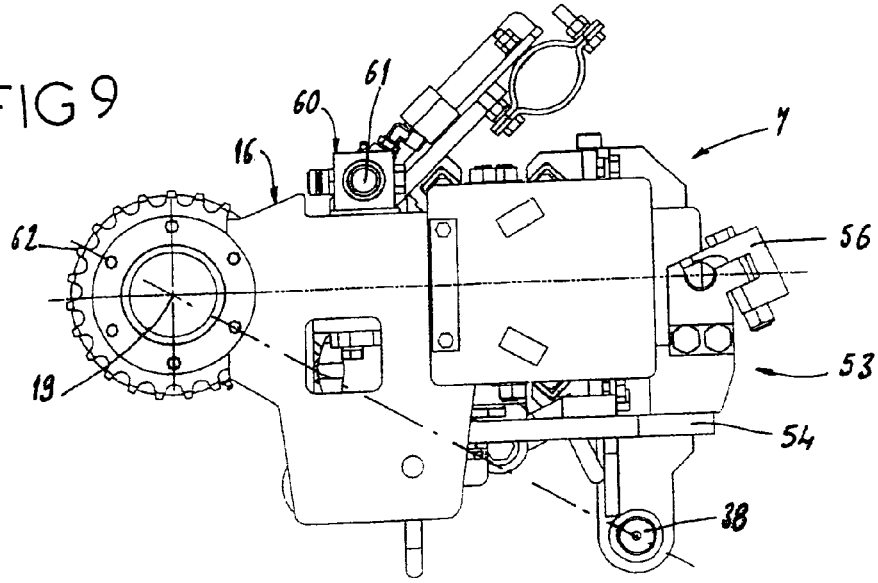
FIG. 9 is a plan view over the bolting head of FIG. 8, the upper part of the latter being removed.
Figure 10:
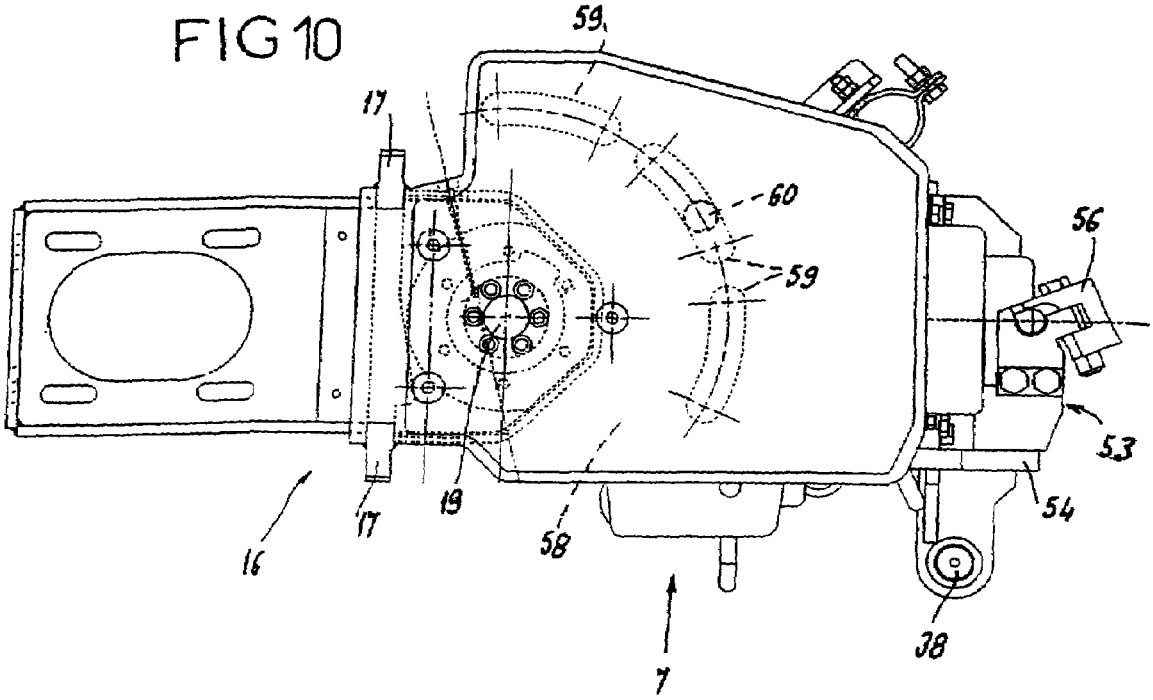
FIG. 10 is a plan view over this complete bolting head.

The following FIGS. 8, 9 and 10 illustrate yet other variants of the bolting head which is the subject of the present invention.

Referring more particularly to FIGS. 8 and 9, the upper steady rest 40 of the first embodiment is replaced here by a steady rest 53 of the same function, formed by an oblique arm 54 articulated on the beam 21 about a vertical axis 55 located on the side of the bolting head 7, at an intermediate height. The end of the arm 54 carries an opening gripper 56 capable of having the drilling tool passing through it in order to ensure the guidance of the latter. The pivoting mounting of the arm 54 allows the lateral retraction of the steady rest 53. Furthermore, means 57 can ensure the indexing of the arm 54 in one or more angular positions, in particular the position of use in which the gripper 55 is coaxial to the drill 26. The opening of the gripper 56 allows a lateral introduction and extraction of the drilling tool or a lateral retraction of the steady rest 53 without the removal of the drilling tool. This opening of the gripper 56 may be carried out hydraulically by means of a device of the "collet chuck" type.

FIGS. 8 to 10 also illustrate an alternative to the device consisting of the notches 28, the locking lever 29 and the stops 39 in the first embodiment. Here, the intermediate support 16 comprises, on its top, a horizontal plate 58 in which are formed, on one and the same circle centered on the vertical axis 19, three successive slots 59 in the form of an arc of a circle, which are all of the same angular extent, corresponding to the range of the rotation of the assembly consisting of the beam 21, of the slide 23 and of the drill 26 between the drilling position and the position for introducing the bolt placed in the receptacle 38. A vertical jack 60, the body of which is fastened to the side of the beam 21, possesses a moveable rod 61 directed upward and capable of being engaged selectively into one of the three slots 59 in the form of an arc of a circle, this making it possible:

- to preposition the abovementioned orientable assembly by selecting one of the three working zones: central zone, right lateral zone, left lateral zone;
- to form, by the cooperation of the extracted jack rod 61 with the ends of a slot 59, stops which, for each working zone, define the angular end positions of said orientable assembly, locking being capable of being carried out by the jack 60.

In this context, FIG. 8 also shows the receiving gearwheel 62, over which passes the endless chain 52 by means of which this orientable assembly is pivoted about the vertical axis 19.

It will be noted that, in this last embodiment, the jack 60 may itself also be controlled remotely, in particular be radio-controlled, thus avoiding any manual intervention on site, in contrast to the notched device 28 and locking lever 29 of the first embodiment.

There would be no departure from the scope of the invention, as defined in the accompanying claims, by a modification, in particular, of:

- the details of the form of the components of the bolting head;
- the type and arrangement of the various jacks and motors driving this bolting head;
- the characteristics of the carrying vehicle on which said bolting head is fitted.

Furthermore, the characteristics described in relation to the various embodiments illustrated in the drawing may be combined in a different way.

The invention claimed is:

1. A drilling and bolting head for a bolting machine, said head being intended to be mounted on a carrying vehicle, wherein said head comprises, in combination:

- an intermediate support mounted slideably in the vertical direction, at least in the position of use, on an element capable of being connected to one end of the carrying vehicle, and, at least in the position of use, defining a vertical axis of rotation;
- a vertical beam that is mounted pivotally along the vertical axis defined by the intermediate support and which is provided with means of vertical guidance;
- a vertically arranged slideway that is mounted slideably on the means of vertical guidance equipping the vertical beam and which is itself provided with means of vertical guidance;
- a drill, with means for the drilling and for the fitting of bolts, said drill being mounted slideably on the means of vertical guidance equipping the slideway;
- a horizontal bearing plate that can be used as a mine prop and which is provided in the upper part of the intermediate support;
- for controlling the vertical displacement of the intermediate support, aback arranged vertically along the vertical axis of rotation defined by said support;
- motorized means for controlling the displacement of the slideway in relation to the vertical beam and the displacement of the drill in relation to the slideway.

2. The bolting head as claimed in claim 1, wherein the intermediate support is mounted slideably in the vertical direction on the slide, itself mounted and guided in translational movement on a transversely arranged table provided with means for connecting the latter to one end of the carrying vehicle, motorized means being provided for controlling the displacement of the slide along the table.

3. The bolting head as claimed in claim 2, wherein the means provided for connecting the table to one end of the carrying vehicle are arranged so as to make it possible for the table to be raised and lowered.

4. The bolting head as claimed in claim 3, wherein said connection means comprise, fork joints for the articulation of the table about horizontal axes on bases fastened to the end of the carrying vehicle and, at least one jack mounted between the carrying vehicle and said table.

5. The bolting head as claimed in claim 2, wherein the means for controlling the displacement of the slide along the table comprise a motor carried by said table and an endless chain transmission connecting the motor to the slide.

6. The bolting head as claimed in claim 2, wherein a jack is provided, which is fastened vertically to the slide and which acts as a prop in the downward direction.

7. The bolting head as claimed in claim 2, wherein the intermediate support is mounted pivotally about a horizontal axis with respect to the slide, in order to lay down the bolting head when the latter is not in use.

8. The bolting head as claimed in claim 1, wherein the intermediate support is mounted slideably in the vertical direction on a front part of a telescopic supporting arm, a rear element of which is connected pivotally about a vertical axis to one end of the carrying vehicle, motorized means being provided for controlling the pivoting of the supporting arm and the telescoping of this supporting arm.

9. The bolting head as claimed in claim 1, wherein the slideway is provided with rear vertical guides mounted slideably in guide shoes equipping the vertical beam and is also provided with front vertical guides, on which the drill is mounted slideably.

10. The bolting head as claimed in claim 1, wherein the motorized means for controlling the displacement of the slideway in relation to the vertical beam and the displacement of the drill in relation to the slideway comprise a single motor which, in particular, is carried by the vertical beam and which, by means of at least one chain passing over guide wheels, controls the displacements.

11. The bolting head as claimed in claim 1, wherein means are provided for the prepositioning, in a desired angular position or range, of the orientable assembly consisting of the vertical beam, of the slideway and of the drill in relation to the intermediate support.

12. The bolting head as claimed in claim 11, wherein said prepositioning means comprise, on the upper part of the intermediate support, a prepositioning quadrant provided with a series of notches and, articulated on the top of the vertical beam, a locking lever capable of being introduced into one of the notches of the prepositioning quadrant.

13. The bolting head as claimed in claim 12, wherein two stops are also provided for the angular positioning of the slideway in the drilling position or in the bolt introduction position.

14. The bolting head as claimed in claim 11, wherein said prepositioning means comprise, on the intermediate support, a horizontal upper plate, in which are formed, on one and the same circle centered on the vertical axis of rotation defined by said support, at least two successive slots in the form of an arc of a circle, of angular extent corresponding to the range of rotation of the slideway between the drilling position and the bolt introduction position, while the above mentioned beam has mounted on it a vertical jack, of which the moveable element directed upward, is capable of being engaged selectively into one of the slots in the form of an arc of a circle.

15. The bolting head as claimed in claim 1, wherein the beam carries a steady rest for the drilling tool.

16. The bolting head as claimed in claim 15, wherein the steady rest is formed by an oblique arm articulated on the beam about a vertical axis located on one side of the bolting head, at an intermediate height of the latter, the end of the arm carrying an opening gripper capable of having the drilling tool passing through it in order to ensure the guidance of the latter.

17. The bolting head as claimed in claim 1, wherein the drill is mounted on a support that also carries laterally a vertical receptacle for the positioning and introduction of a bolt, said receptacle and the drilling line of the drill being located on one and the same circle centered on the above-mentioned vertical axis.

18. The bolting head as claimed in claim 1, wherein a plate is provided for protecting the rear part of the drill, said plate being carried by the lower part of the slideway.

19. The bolting head as claimed in claim 1, wherein its motorized translational and rotational movements are radio-controlled movement.

* * * * *